US006752588B2

(12) United States Patent
Kawanishi et al.

(10) Patent No.: US 6,752,588 B2
(45) Date of Patent: Jun. 22, 2004

(54) VACUUM PUMP

(75) Inventors: Shinji Kawanishi, Narashino (JP); Yoshiyuki Sakaguchi, Narashino (JP); Yasushi Maejima, Narashino (JP); Satoshi Okudera, Narashino (JP)

(73) Assignee: BOC Edwards Technologies Limited, Chiba (JP)

( * ) Notice: Subject to any disclaimer, the term of this patent is extended or adjusted under 35 U.S.C. 154(b) by 25 days.

(21) Appl. No.: 10/294,828

(22) Filed: Nov. 14, 2002

(65) Prior Publication Data

US 2003/0095862 A1 May 22, 2003

(30) Foreign Application Priority Data

Nov. 19, 2001 (JP) ..... 2001-353741
Sep. 12, 2002 (JP) ..... 2002-267257

(51) Int. Cl.[7] ..... F04D 19/04
(52) U.S. Cl. ..... 415/90; 415/143; 415/214.1
(58) Field of Search ..... 415/9, 90, 143, 415/214.1, 173.4, 174.4; 417/423.4

(56) References Cited

U.S. PATENT DOCUMENTS 4,086,012 A 4/1978 Buckley et al. ..... 403/2

FOREIGN PATENT DOCUMENTS

JP 10274189 10/1998

OTHER PUBLICATIONS

Patent Abstracts of Japan, vol. 1996, No. 09, Sep. 30, 1996.

JP 08114196 A (Mitsubishi Heavy Ind Ltd.), May 7, 1996.

*Primary Examiner*—Edward K. Look
*Assistant Examiner*—Dwayne J. White
(74) *Attorney, Agent, or Firm*—Adams & Wilks

(57) ABSTRACT

The present invention provides a vacuum pump in which a damaging torque produced when a rotating rotor crashes into the inner wall of a pump case, is prevented to transfer to a vacuum chamber so as to protect the vacuum chamber. Bolt-holes of flange portions, through which the vacuum pump and the vacuum chamber and also the pump case and a base member disposed below the pump case are fastened, respectively, are formed so as to have larger diameters than the shank diameters of corresponding bolts by 20% or more. With this arrangement, when the entire vacuum turns moved by the damaging torque, the pump case slips relative to the vacuum chamber and the base member by the gaps between the pump case-base member fastening bolt-holes and the pump case-base member fastening bolts. As a result, the damaging torque is absorbed and is prevented to transfer to the vacuum chamber.

12 Claims, 9 Drawing Sheets

(a)

(b)

PRIOR ART

VACUUM PUMP

BACKGROUND OF THE INVENTION

1. Field of the Invention

The present invention relates to a vacuum pump, such as a turbo-molecular pump, which produce a vacuum by using the rotation of its rotor, used for a semiconductor manufacturing apparatus, an electron microscope, a surface analyzing apparatus, a mass spectroscope, a particle accelerator, a nuclear fusion experiment apparatus 2. Description of the Related Art For example, a process such as dry etching process or chemical vapor deposition (CVD) of semiconductor manufacturing process is required to be performed in a vacuum environment, and a vacuum pump such as a turbo-molecular pump having a high-speed rotor is used to produce such a vacuum.

As a conventional vacuum pump, for example, it is disclosed in Japanese Utility Model Application No. Hei.4-52644 (Kokai-publication No.Hei.6-14491). In this type of vacuum pump, as shown in FIG. 9, a gas suction port 2 provided at the top portion of a pump case 1 is in communication with an exhaust port 21 of a vacuum chamber 200. In this communication structure, a flange portion 1*a* provided around the top periphery of the pump case 1 is attached and fixed to the vacuum chamber 200 with a pump-chamber fastening bolt 30.

More particularly, several pump fastening bolt-holes 22 are equally spaced and formed around the chamber exhaust port 21 of the vacuum chamber 200, while the flange portion 1*a* of the vacuum pump 100 is formed so as to surround the gas suction port 2 and bolt-holes 3 are equally spaced and formed at the flange portion 1 so as to correspond to several pump fastening bolt-holes 22. The pump-chamber fastening bolt 30 is inserted and screwed from the lower side of the flange portion 1*a* into the pump fastening bolt-holes 22 through each bolt-holes 3, thereby attaching and fixing the vacuum chamber 200 to the vacuum pump 100. The gap between the shank of each fastening bolt 30 and the inner wall of the corresponding fastening bolt-hole 3 is set in accordance with the normal standardized sizes of a bolt and a bolt-hole. For example, the bolt-hole 3 is formed to have a diameter of 11 mm for the shank of the bolt 30 having a diameter of 10 mm.

A base member 4, which is separated from the pump case 1, is provided at the lower side of the pump case 1. Similarly to the connecting structure between the vacuum pump 100 and the vacuum chamber 200, the connecting between the separated base member 4 and the pump case 1 are performed by that a flange shaped base fastening portion 1*b* formed at the bottom periphery of the pump case 1 is fastened and fixed to the separated base member 4 by bolts (not shown).

In the vacuum pump 100 attached and fixed to the vacuum chamber 200, the rotor shaft 5 rotates at high speed together with the rotor 6 and the rotor blades 7 when the vacuum pump 100 is in operation. With this structure, the interaction between the rotor blades 7 rotating at high speed and the stator blades 8 and the other interaction between the rotor 6 rotating at high speed and the screw stator 10 having the screw grooves 10*a* cause gas molecules in the vacuum chamber 200 to pass through the gas suction port 2 and subsequently the pump case 1, and to be eventually exhausted from the pump exhaust port 11.

A light alloy is generally used and, in particular, an aluminum alloy is widely used as the structural material of the rotor 6, the rotor blades 7, the stator blades 5 and so forth which form the vacuum pump 100, since the aluminum alloy is excellent in machining and can be precisely processed without difficulty. However, the hardness of aluminum alloy is relatively low as compared with other materials used for the structural material, and accordingly aluminum alloy may cause a creep fracture depending on the operating condition. Also, a brittle fracture may occur mainly caused by a stress concentration at the lower portion of the rotor 2, when the vacuum pump is in operation.

In the conventional vacuum pump 100 having the above-described structure, when a brittle fracture occurs in the rotor 6 rotating at high-speed, for example, and a part of the rotor 6 crashes into the screw stator 10, since the screw stator 10 has an insufficient strength against a shock load caused by this crash, the screw stator 10 cannot absorb such a shock load and therefore radially moves and crashes into a base member 4. Accordingly, this shock load produces a high rotating torque (hereinafter, referred to as "damaging torque") which causes the entire vacuum pump to rotate and which causes problems in that the entire pump case 1 is distorted, the fastening bolts 30 fastening the vacuum pump 100 to the vacuum chamber 200 are broken by this distortion torque, and the vacuum chamber 200 is broken by the large damaging torque transferred thereto.

SUMMARY OF THE INVENTION

The present invention is made to solve the above-described problems. Accordingly, it is an object of the present invention to provide a vacuum pump which reduces a damaging torque produced and prevent transferring of the damage torque to the outside when a rotor rotating at high-speed crashes into a screw stator or the like so as to prevents a vacuum chamber or the like from being broken by the damaging torque transferred to the vacuum chamber or the like.

A vacuum pump according to the present invention comprises: a rotor 6; a pump case 1 surrounding the rotor; a flange portion 1*a* formed around the top periphery of the pump case; a plurality of pump fastening holes 22 provided at a periphery of an exhaust port 21 of a vacuum chamber 200 facing the upper surface of the flange portion; a plurality of vacuum chamber fastening bolt-holes 3 provided in the flange portion 1*a* so as to correspond to the pump fastening holes 22, said vacuum chamber fastening bolt-holes being passed through with a pump-chamber fastening bolt 30; a base fastening portion 1*b* formed around the bottom periphery of the pump case; a base 4 covering the lower side of rotor 6 and facing the lower surface of the base fastening portion 1*b*; a plurality of pump case-base member fastening holes 17 and 18 provided so as to correspond to the base fastening portion 1*b* and the base 4, respectively; and a plurality of pump case-base member fastening bolts 19 for fastening the pump case 1 and the base 4 by inserting and screwing into the pump case-base member fastening holes 17 and 18; wherein the dimensional relationships between the diameter of each bolt-hole and that of the shank of the corresponding bolt satisfy both or either one of the following conditions (a) and (b):

(a) a vacuum chamber fastening bolt-hole 3 has a larger diameter than the shank diameter 30*d* of the corresponding pump-chamber fastening bolt 30 by 20% or more; and (b) a bolt-hole, which is either one of the pump case-base member fastening bolt-holes 17 and 18 provided in the base fastening portion 1*b* and the base 4, has a larger diameter than the shank diameter 19*d* of the corresponding pump case-base member fastening bolt 19 by 20% or more.

A vacuum pump according to the present invention further comprises: a rotor 6; a pump case 1 surrounding the rotor; a flange portion 1*a* formed around the top periphery of the pump case; a plurality of pump fastening holes 22 provided at a periphery of an exhaust port 21 of a vacuum chamber 200 facing the upper surface of the flange portion; a plurality of vacuum chamber fastening bolt-holes 3 provided in the flange portion so as to correspond to the pump fastening holes 22, said vacuum chamber fastening bolt-holes being passed through with a pump-chamber fastening bolt 30; a base fastening portion 1*b* formed around the bottom periphery of the pump case; and a plurality of pump case-base member fastening bolts 19 for fastening the pump case 1 and the base 4 by inserting and screwing into the pump case-base member fastening holes 17 and 18, wherein the positional relationships between the fastening bolt-holes and the corresponding fastening bolt satisfy both or either one of the following conditions (a) and (b):

(a) when the pump case 1 turns moved by a damaging torque, the gaps between the pump-chamber fastening bolts 30 and the corresponding vacuum chamber fastening bolt-holes 3 with respect to the turning direction of the pump case moved by the damaging torque are distributed within the range of 10% of the shank diameter of the bolt; and (b) when the pump case turns moved by a damaging torque, the gaps between the pump case-base member fastening bolts 19 and the corresponding bolt-holes 17 and 18 with respect to the turning direction of the pump case moved by the damaging torque are distributed to the ranges including the range of 10% of the shank diameter of the bolt.

In the vacuum pump according to the present invention, the gap between each fastening bolt and the corresponding bolt-hole satisfies both or either one of the following conditions (a) and (b):

(a) a buffer member 50 is inserted into the gap between each pump-chamber fastening bolt 30 and the corresponding vacuum pump fastening bolt-hole 3; and (b) a buffer member 50 is inserted into the gap between each pump case-base member fastening bolt 19 and the corresponding fastening bolt-hole 17 and 18.

With this configuration, the buffer members 50 absorb the damaging torque.

According to the present invention, the fastening bolts may satisfy both or either one of the following conditions (a) and (b):

(a) the pump-chamber fastening bolts are reduced diameter shank bolts; and (b) the pump case-base member fastening bolts are reduced diameter shank bolts.

With this arrangement, the extending property of the reduced diameter shank bolts contributes to reducing the damaging torque.

According to the present invention, the fastening bolts satisfy both or either one of the following conditions (a) and (b):

(a) the pump-chamber fastening bolt 30 is an reduced diameter shank bolt; and (b) the pump case-base member fastening bolt 19 is an reduced diameter shank bolt.

With this configuration, the characteristic of the reduced diameter shank bolt contributes to absorbing of damaging torque.

A joint structure of a vacuum pump according to the present invention comprises: a plurality of pump fastening holes 22 provided at periphery of an exhaust port 21 of a vacuum chamber 200; a flange portion 1*a* formed around the top periphery of the pump case 1, which surrounds the rotor 6 of the vacuum pump; a plurality of vacuum chamber fastening bolt-holes 3 provided in the flange portion 1*a* so as to correspond to the pump fastening holes 22; and a plurality of pump-chamber fastening bolts 30 for fastening the periphery of the exhaust port 21 of a vacuum chamber and the flange portion 1*a* by inserting and screwing into the pump fastening holes 22 and the pump fastening holes 22, wherein either diameter of the pump fastening holes 22 and the vacuum chamber fastening holes 3 has a larger diameter than the shank diameter 30*d* of the corresponding pump-chamber fastening bolt 30 by 20% or more.

A joint structure of a vacuum pump according to the present invention comprises: a plurality of pump fastening holes 22 provided at periphery of an exhaust port 21 of a vacuum chamber 200; a flange portion 1*a* formed around the top periphery of the pump case 1, which surrounds the rotor 6 of the vacuum pump; a plurality of vacuum chamber fastening bolt-holes 3 provided in the flange portion 1*a* so as to correspond to the pump fastening holes 22; and a plurality of pump-chamber fastening bolts 30 for fastening the periphery of the exhaust port 21 of a vacuum chamber and the flange portion 1*a* by inserting and screwing into the pump fastening holes 22 and the pump fastening holes 22, wherein when the pump case 1 turns moved by a damaging torque, the gaps between the pump-chamber fastening bolts 30 and the corresponding vacuum chamber fastening bolt-holes 3 with respect to the turning direction of the pump case moved by the damaging torque are distributed to the ranges including the range of 10% of the shank diameter of the bolt.

In the joint structure of a vacuum pump according to the present invention, a buffer member 50 is inserted into the gap between each pump-chamber fastening bolt 30 and the corresponding bolt-hole which is either one of the vacuum chamber fastening hole 3 and the pump fastening hole 22. With this arrangement, the buffer members 50 contribute to absorbing of damaging torque.

In the joint structure of a vacuum pump according to the present invention, the pump-chamber fastening bolt 30 is a reduced diameter shank bolt. With this arrangement, the extending property of the reduced diameter shank bolts the reduced diameter shank bolt contributes to absorbing of damaging torque reducing the damaging torque.

In this description, a hole such as a flange portion fastening hole, a pump fastening hole or a pump case-base member fastening hole means a screw hole which engages with the male-threaded portion of corresponding bolt or a bolt-hole which allows the shank of the corresponding bolt to pass therethrough and which has a larger diameter than the shank diameter. Also, fastening holes are used in the following two combinations:

(1) A Combination of a Bolt-hole and a Screw Hole:

The male-threaded portion of a bolt passing through the bolt-hole is screwed into and fastened to the female-treaded portion of the screw hole.

(2) A Combination of a Pair of Bolt-holes and a Nut:

The male-threaded portion of a bolt passing through the pair of bolt-holes is screwed into and fastened to the nut.

Also, in this present invention, when a bolt has a shank between the bolt head and the male-threaded portion thereof, a shank diameter of the bolt is defined by the diameter of the shank having no thread thereon, and when the bolt has no shank between the bolt head and the male-threaded portion thereof, a shank diameter is defined by the diameter of the crest of the male-threaded portion. A shank diameter of a reduced diameter shank bolt is defined by the diameter of its reduced-diameter portion. It will be apparent to those skilled in the art that bolts include not only strictly defined ones but also rod-like screws such as a machine screw.

According to the present invention, when the damaging torque causes the entire vacuum pump to turn, the inner surfaces of the bolt-holes closest to the outer surfaces of the corresponding pump-chamber fastening bolts first come into contact with these outer surfaces, and start causing these bolts to be deformed and broken. Subsequently, the other portion of the inner surfaces of the bolt-holes second closest the outer surfaces of the corresponding pump-chamber fastening bolts come into contact with these outer surfaces, and start causing these bolts to be deformed and broken. Similar deformations and breaking of the bolts sequentially occur contacted by the bolt-holes whose outer surfaces are sequentially spaced away from the corresponding bolts. During this deformation and breaking process of the bolts, the damaging torque is absorbed and also the peak value of the breaking toque is reduced.

DESCRIPTION OF THE PREFERRED EMBODIMENTS

Preferred embodiments of a vacuum pump according to the present invention will be described with reference to the accompanying drawings.

Figure 1:
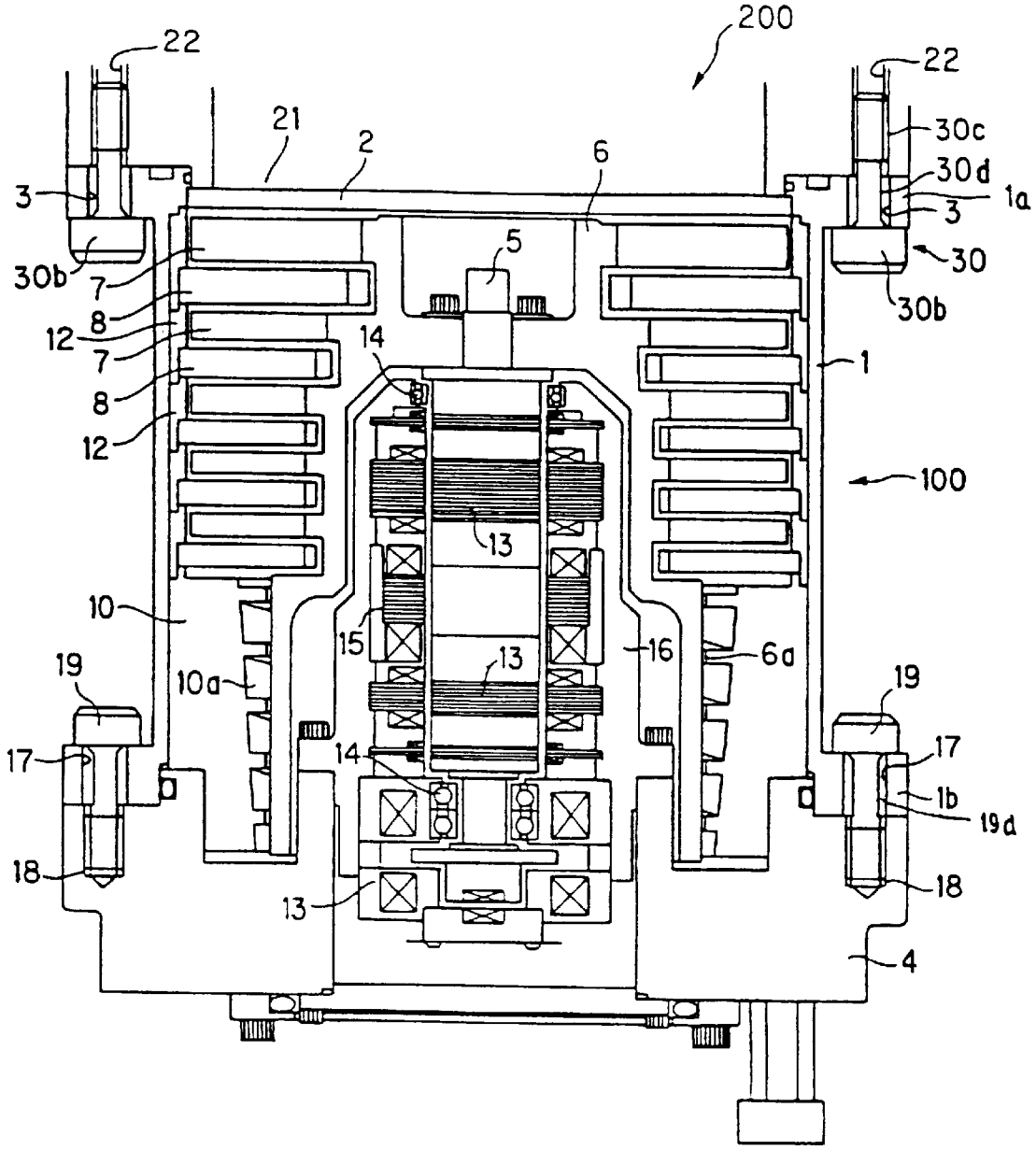
FIG. 1 is a vertical sectional view of an embodiment of a vacuum pump according to the present invention.

FIG. 1 is a vertical sectional view of an embodiment of a vacuum pump according to the present invention. A vacuum pump 100 as shown FIG. 1 has a cylindrical rotor 6 rotatably disposed in a cylindrical pump case 1 such that the top end portion of the rotor 6 faces a gas suction port 2 disposed at the top of the pump case 1.

Pluralities of processed rotor blades 7 and stator blades 8 are disposed between the outer circumferential surface of the upper part of the rotor 6 and the inner wall of the upper part of the pump case 1 such that these blades 7 and 8 are alternately disposed in a direction along the rotation center axis of the rotor 6.

The rotor blade 7 is integrally formed with the rotor 6 and disposed on the outer circumferential surface of the upper part of the rotor 6 so as to rotate together with the rotor 6. On the other hand, the stator blade 8 is positioned and arranged between the adjacent upper and lower rotor blades 7 via spacer 12, which is positioned at upper portion of the inner wall of the pump case 1, and also is secured to the inner wall of the pump case 1 via spacer 12.

A screw stator 10 is disposed so as to face the outer circumferential surface 6*a* of the lower part of the rotor 6. The entire screw stator 10 has a cylindrical shape so as to surround the outer circumferential surface of the lower part of the rotor 6 and is integrally secured to a base member 4 provided under the pump case 1.

In addition, screw groove 10*a* is formed on the surface of the screw stator 10 so as to face an outer circumferential surface 6*a* of the lower part of the rotor 6.

A rotor shaft 5 is integrally fixed to the rotor 6 along the rotation center axis of the rotor 6. Although a variety of bearing means including magnetic bearings and air bearings can be used for rotatably supporting the rotor shaft 5, the rotor shaft 5 is rotatably supported by magnetic bearings 13 in the figure. Also, Ball bearings 14, which serve as auxiliary bearings, are used for temporarily supporting the rotor shaft 5 when the magnetic bearings 13 do not work well. The rotor shaft 5 is driven to rotate by a drive motor 15.

The drive motor 15 and the magnetic bearings 13 have respective stators on a stator column 16, which is provided so as to be erected and is fixed to the base member 4 inside the rotor 6.

In this embodiment, an aluminum alloy is used as the material for the base member 4, the rotor 6, the rotor blade 7, the stator blade 8, and the spacer 12, and a steel is used as the material for the pump case 1, the rotor shaft 5 and bolts 19 and 30.

A gas suction port 2 provided on the pump case 1 is connected to an exhaust port 21 of a vacuum chamber 200 which is to be highly evacuated, while a gas exhaust port (not shown in the figure) provided in the base member 4 is communicated with the lower pressure side.

The joint structure between the vacuum chamber 200 and the vacuum pump 100 and that between the pump case 1 and the base member 4, which are the features of the present invention, will be described in further detail.

A flange portion 1*a*, which surrounds the gas suction port 2 formed around the top periphery of the pump case 1, has a plurality of vacuum chamber fastening bolt-holes (vacuum chamber fastening hole) 3. The above vacuum chamber fastening bolt-holes 3 are provided for being perforated therein by a pump-chamber fastening bolt 30 in the flange portion 1*a* so as to correspond to a plurality of pump fastening hole 22 provided at the circumferential side of a exhaust port 21 of the vacuum chamber 200, which contacts the upper surface of the flange portion 1*a*. In this embodiment, the pump fastening bolt-hole 22 of the vacuum chamber 200 is threaded. Thus, the vacuum pump 100 and the vacuum chamber 200 are fastened by inserting and screwing the pump-chamber fastening bolt 30 into the vacuum chamber fastening bolt-holes 3 of the vacuum pump 100 from below.

In this case, a reduced diameter shank bolt 30 is used as pump-chamber fastening bolt 30. As is well known, the reduced diameter shank bolt 30 is composed of a bolt head 30*b*, a male-threaded portion 30*c* and a reduced-diameter portion 30*d* as a part of a shank between the bolt head 30*b* and the male-threaded portion 30*c*. The diameter of the reduced-diameter portion 30*d* is formed so as to be smaller than the root diameter of the male-threaded portion 30*c* such that the reduced-diameter portion 30*d* extends and accordingly prevents components in the vicinity of the bolt from being damaged when an extraordinary load is exerted on the bolt 30.

The reduced diameter shank bolt 30 is screwed into the corresponding pump-chamber fastening hole 22 such that the boundary between the reduced-diameter portion 30*d* and the male-threaded portion 30*c* enters the pump-chamber fastening hole 22 by the length of one or two threads of the bolt 30.

The vacuum chamber fastening bolt-hole 3 is formed so as to have a sufficiently large diameter, namely, a larger diameter than the shank diameter 30*d* of the corresponding pump-chamber fastening bolt 30 to be inserted into the vacuum chamber fastening bolt-hole 3 by 20% or more.

A similar connecting structure to that between the vacuum chamber 200 and the vacuum pump 100 is adopted to connect the pump case 1 and the base member 4.

More particularly, a flange-shaped base fastening portion 1*b* is formed around the bottom periphery of the pump case 1. The base member 4 contacts the lower surface of the base fastening portion 1*b* and surrounds the lower part of a rotating body including the rotor 6 disposed in the pump case 1.

The base fastening portion 1*b* and the base member 4 have pluralities of pump case-base member fastening holes 17 and 18 formed therein, used for fastening the pump case 1 to the base member 4, so as to correspond to each other. Thus, the pump case 1 and the base member 4 are fastened by inserting and screwing pump case-base member fastening bolts (reduced diameter shank bolts) 19. In this embodiment, the pump case-base member fastening holes 17 of a base fastening portion 1*b* is formed to be a bolt-hole and the pump case-base member fastening hole 18 of the base 4 is a threaded hole, thereby making the vacuum pump 100 compact and allowing the pump case 1 and the base member 4 to be easily assembled together.

Figure 6:
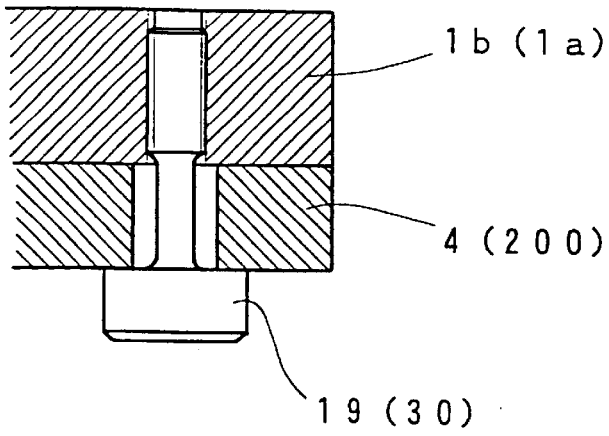
FIGS. 6(*a*) and 6(*b*) illustrate are fastening bolts and bolt-holes of another embodiment according to the present invention.
Figure 6:
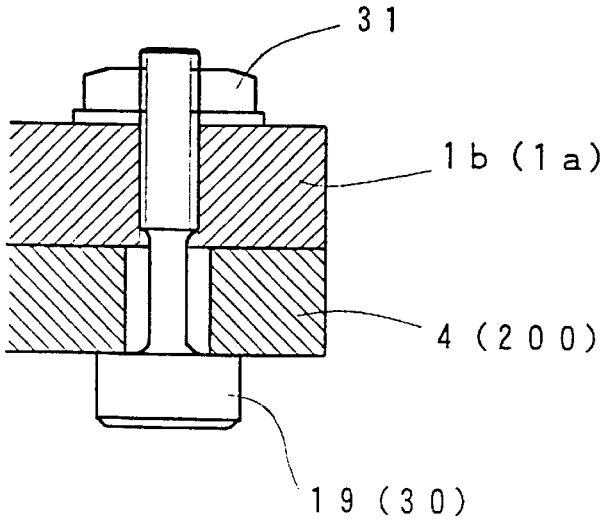

Instead of the above-described configuration, the holes 3 and 22 may be a threaded hole and a bolt-hole, respectively, as shown in FIG. 6(*a*). Alternatively, as shown in FIG. 6(*b*), both the holes 3 and 22 may be bolt-holes. In this case, the vacuum pump 100 and the vacuum chamber 200 are fastened by inserting the pump-chamber fastening bolts 30 into the holes 3 and 22 such that a part of each bolt 30 protrudes from the corresponding bolt-hole 3 and by tightening nut 31 on the protruding parts of the fastening bolt 30. The same applies to the fastening structure of the pump case 1 and the base member 4 by using the holes 17 and 18, the pump case-base member fastening bolt 19, and the nut 31. When the nuts 31 are used, either one group of the bolt-holes 3 and 22 or either one group of the bolt-holes 17 and 18 are not required to have particularly large diameters and accordingly may have standard diameters.

Even when the reduced diameter shank bolt is not used as the pump-chamber fastening bolt 30 or the pump case-base member fastening bolt 19, that is, even when a standard bolt having a shank whose diameter is about the same as the diameter of its thread is used, a larger one of the bolt-holes 3 and 22 or a larger one of the bolt-holes 17 and 18 is formed so as to have a larger diameter, by 20% or more, than the shank 30*d* of the fastening bolt 30 or the shank 19*d* of the fastening bolt 19, respectively.

Subsequently, an absorption process of a damaging torque produced in the vacuum pump 100, shown in FIG. 1, having the above-described structure will be described. When the rotor 6 rotating at high speed is broken by any problems during the vacuum pump 100 is in operation, a large torque which causes the entire vacuum pump 100 to rotate is produced and exerted on the pump case 1 and the base member 4.

Since the pump case 1 is connected to the large vacuum chamber 200, a large shearing force is exerted on the pump-chamber fastening bolts 30 connecting the vacuum chamber 200 to the pump case 1 on which the damaging torque is exerted. The base member 4 connected to the pump case 1 hangs down therefrom. Since the broken rotor 6 or the like is less likely to crash into the base member 4 than the pump case 1, the base member 4 is exerted a small damaging torque directly from the broken rotor 6 or the like and, instead, receives a large damaging torque directly from the pump case 1. In other words, a large shearing force is exerted also on the pump case-base member fastening bolts 19 connecting the pump case 1 to the base member 4.

According to the above described embodiment, the damaging torque causing the pump-chamber fastening bolt 30 and the pump case-base member fastening bolt 19 to be exerted the respective shearing forces is absorbed and reduced as described below.

As described above, the bolt-holes 3 and 17 have larger diameters, by 20% or more, than the shank diameters (i.e., the diameters of the reduced-diameter portions 30*d* and 19*d*) of the fastening bolts 30 and 19, respectively. Thus, each bolt-hole 3 and the corresponding bolt 30 as well as each bolt-hole 17 and the corresponding bolt 19 have sufficient gaps therebetween. Accordingly, the flange portions 1*a* and the base fastening portion 1*b* are allowed to slip relative to the vacuum chamber 200 and the base member 4, respectively, by the lengths corresponding to the respective gaps. Accordingly, the damaging torque is absorbed and reduced by these slippages.

When the reduced damaging torque still remains, the shanks of the bolts 30 and 19 come into contact with the walls of the bolt-holes 3 and 17, respectively. With this arrangement, the gaps between the shanks 30*d* and 19*d* and the bolt-holes 3 and 17 allow the shanks 30*d* and 19*d* of the bolts 30 and 19, respectively, to extend and bend, and also, in some cases, be broken. As a result, since the deformations of the reduced-diameter portions 30*d* and 19*d* absorb most of the damaging torque, the threaded portions of the threaded portions 22 and 18 are prevented from being deformed. Accordingly, these joint structures maintain a state in which the bolts 30 and 18 can be removed from the bolt-holes 3 and 17, respectively, thereby making it easy to disassemble the joint structures when performing repair work.

Since the large damaging torque is reduced by the above-described slippages and the deformations and thus is prevented from being transferred to the vacuum chamber 200, the vacuum chamber 200 is prevented from being broken.

In the present invention, it is not indispensable for use of the reduced diameter shank bolts and a similar effect can be obtained by using a standard bolt when the joint structures are properly designed. The reduced diameter shank bolts may be applied to either one of the joint structures between the vacuum pump 100 and the vacuum chamber 200 and between the pump case 1 and the base member 4 so as to absorb the damaging torque by the deformations thereof and to reduce the transfer of the damaging torque to not only the vacuum chamber 200 but also the base member 4.

Figure 2:
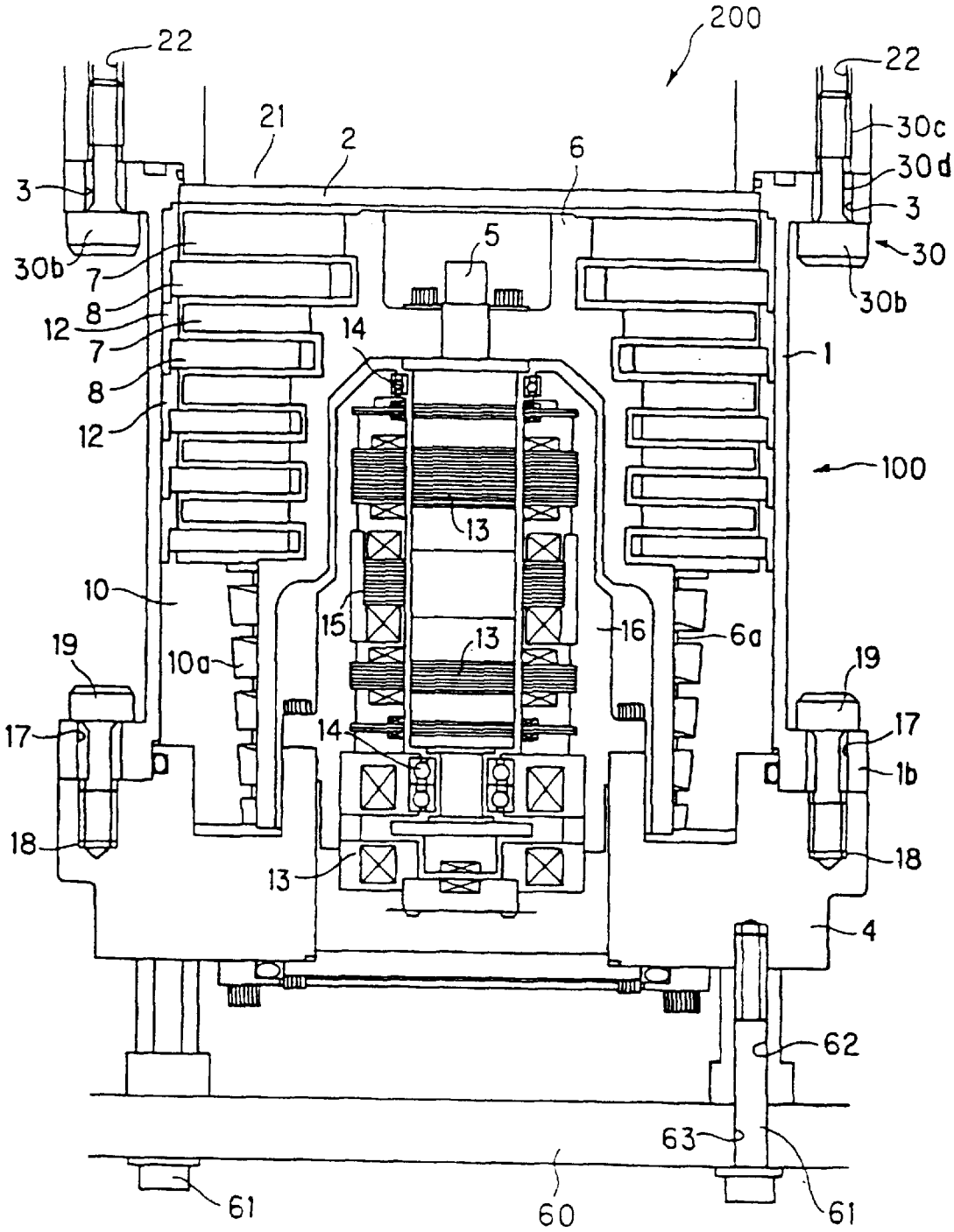
FIG. 2 is a vertical sectional view of another embodiment of a vacuum pump according to the present invention.

FIG. 2 is another embodiment of the vacuum pump according to the present invention. A vacuum pump 100 shown in FIG. 2 is fixed to a pump support member 60 at the bottom portion thereof with pump support bolt 61, thereby being supported by a pump support member 60. The other structure is the same as that shown in FIG. 1.

As shown in FIG. 2, since the base member 4 is fixed to the pump support member 60, when the damaging torque is exerted on the base member 4, the damaging torque may cause the pump support bolts 61 to bend or to be broken. When the pump support bolt 61 and other elements in the vicinity of the support bolt 61 are damaged, necessary disassembling and replacing work becomes difficult. However, in the present invention, as described in the first embodiment shown in FIG. 1, since the damaging torque is absorbed by the deformations of the pump case-base member fastening bolt 19, the support bolt 61 and the other elements in the vicinity of the bolt 61 are not damaged.

As seen from the description concerning the embodiments described above, the gap between the bolt and the bolt-hole plays an important role for absorbing the damaging torque. Therefore, improvements of the gap structures contribute to absorbing the damaging torque more effectively. The improvements of the gap structures will be described one by one.

Figure 3:
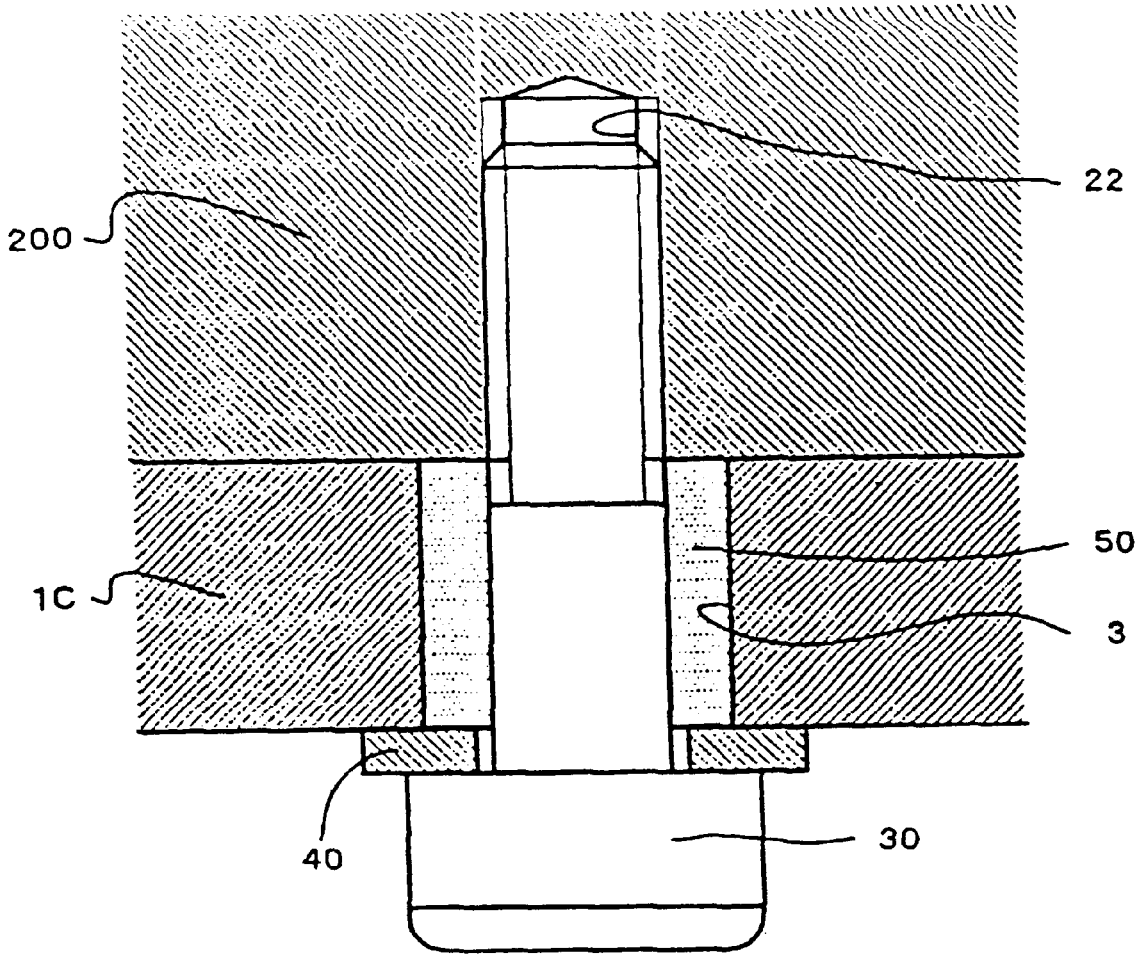
FIG. 3 is a partial vertical sectional view of a further embodiment according to the present invention.

FIG. 3 shows a structure in which a buffer member made of rubber material or the like, similar to O-ring, is inserted into a gap between the bolt and the bolt-hole as shown in FIG. 1 or 2. As shown in FIG. 3, a buffer member 50 is inserted into the gap between the bolt-hole 3 of the flange portion 1*a* and a shank of the pump-chamber fastening bolt 30. In this case, a spring washer 40 is fitted into the shank of the bolt 30.

When the damaging torque exerted on the pump case 1 causes the flange portion 1*a* to slip relative to the vacuum chamber 200 and the bolt 30 to move laterally in the bolt-hole 3, the buffer member 50 is elastically deformed, thereby resulting in further remarkable reduction in the damaging torque.

The effect of the buffer members 50 for absorbing the damaging torque can be applied to not only the connecting portion between the vacuum pump 100 and the vacuum chamber 200 but also that between the pump case 1 and the base member 4.

Figure 4:
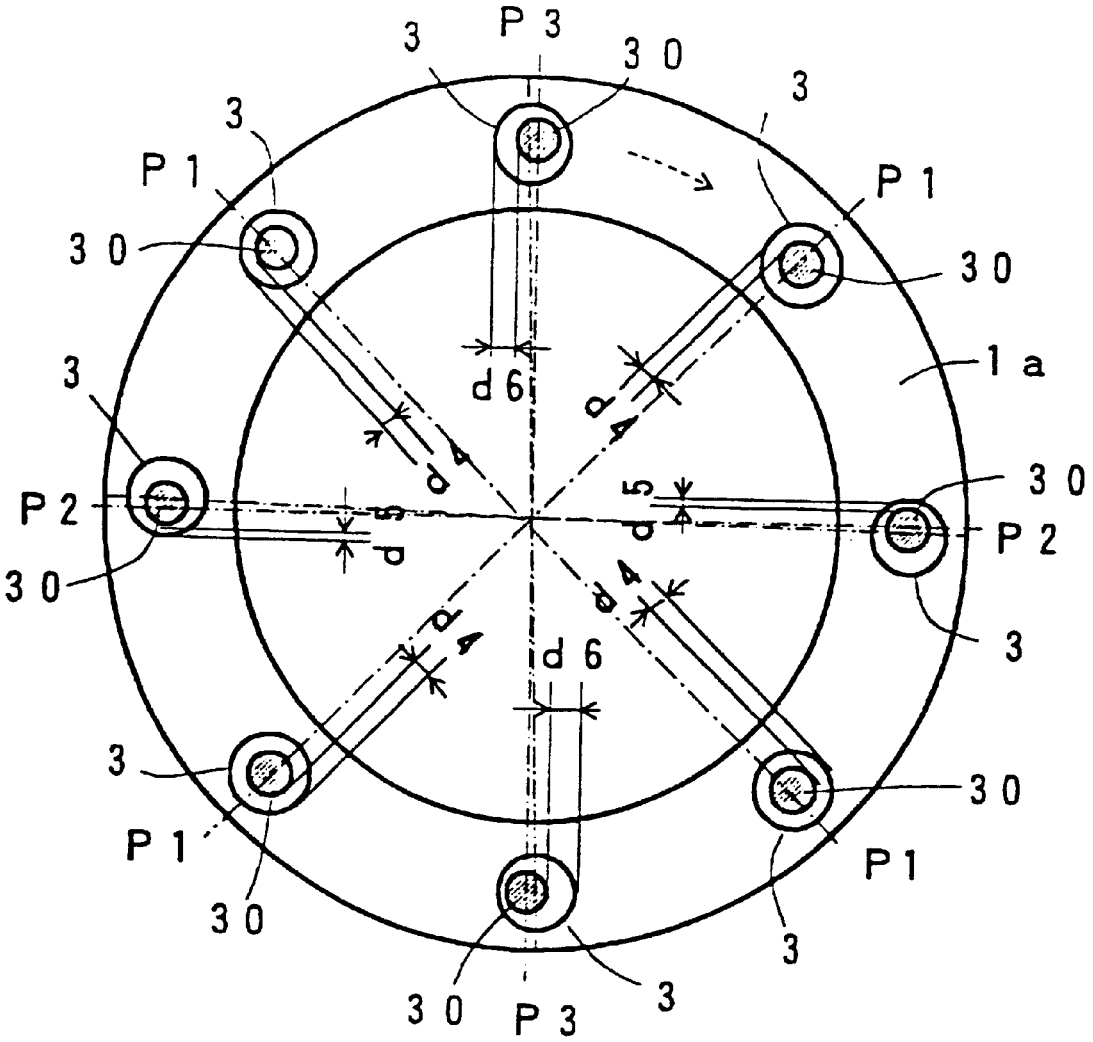
FIG. 4 is a partial plan view of a flange portion according to the present invention.

FIG. 4 is a partial plan view of a flange portion of further embodiment of the vacuum pump according to the present invention. In this case, it is applied to a connecting portion between a vacuum chamber and a vacuum pump.

The flange portion 1*a* shown in FIG. 4 has eight bolt-holes 3 equally spaced therein so as to surround the gas suction port 2. Although these bolt holes 3 have the same diameter, each bolt-hole 3 is shifted relative to the corresponding pump fastening hole 22 (i.e., the pump-chamber fastening bolt 30) by a necessary angle in the circumferential direction of the vacuum pump 100. In this embodiment, the four bolts 30 at first positions P1 are placed coaxially with the corresponding bolt-holes 3, and a middle gap d4 is provided between each bolt-hole 3 and the corresponding bolt 30. Also, the two bolts 30 at second positions P2 are shifted relative to the corresponding bolt-holes 3 in a relatively close manner with respect to a direction shown by the dotted arrow indicated in the figure, and a small gap d5 is provided between each bolt-hole 3 and the rear side of the corresponding bolt 30 when viewed from the direction shown by the arrow. In addition, the remaining two bolt-holes 30 at third positions P3 are shifted in a relatively spaced-out manner, and a large gap d6 is provided between each bolt-hole 3 and the rear side of the corresponding bolt 30.

The above gaps d4, d5 and d6 which are provided between the bolts and the corresponding bolt-holes and by which the bolts and the corresponding bolt-holes relatively come close to each other are set to be 10%, 15%, and 5% of the shanks of the corresponding bolts in FIG. 4. The gap d4 equivalent to 10% of the shank diameter corresponds to a case in which, as shown in FIG. 1, the bolt-hole 3 or 17 has a larger diameter, by 20% or more, than the shank diameter of the bolt 30 or 19, respectively.

Although the level of variations in these gaps is appropriate, the present invention is not limited to the three values of gaps as shown in FIG. 4. The practical minimum gap is about 0.5 mm, which is the average gap between the standard bolt and bolt-hole having, for example, diameters of 10 mm and 11 mm, respectively. A considerably large maximum gap is possible for elongated holes or the like formed along the circumferential periphery of the pump case 1. In any cases, the distributed distance (gap) of the shank diameter of the bolt preferably falls within the range including the range of 10% of the shank diameter of the bolt so that the damaging torque is effectively absorbed.

According to the embodiment shown in FIG. 4, since the gaps d4, d5 and d6 between the bolts and the corresponding bolt-holes are different from each other, the timing of the bolts, having the gaps d4, d5 and d6, coming into contact with the corresponding bolt-holes and starting their deformations is delayed by the differences in the gaps from each other.

The shifting of timing of deformation in the embodiment shown in FIG. 4 will be explained with reference to FIG. 5.

Figure 5:
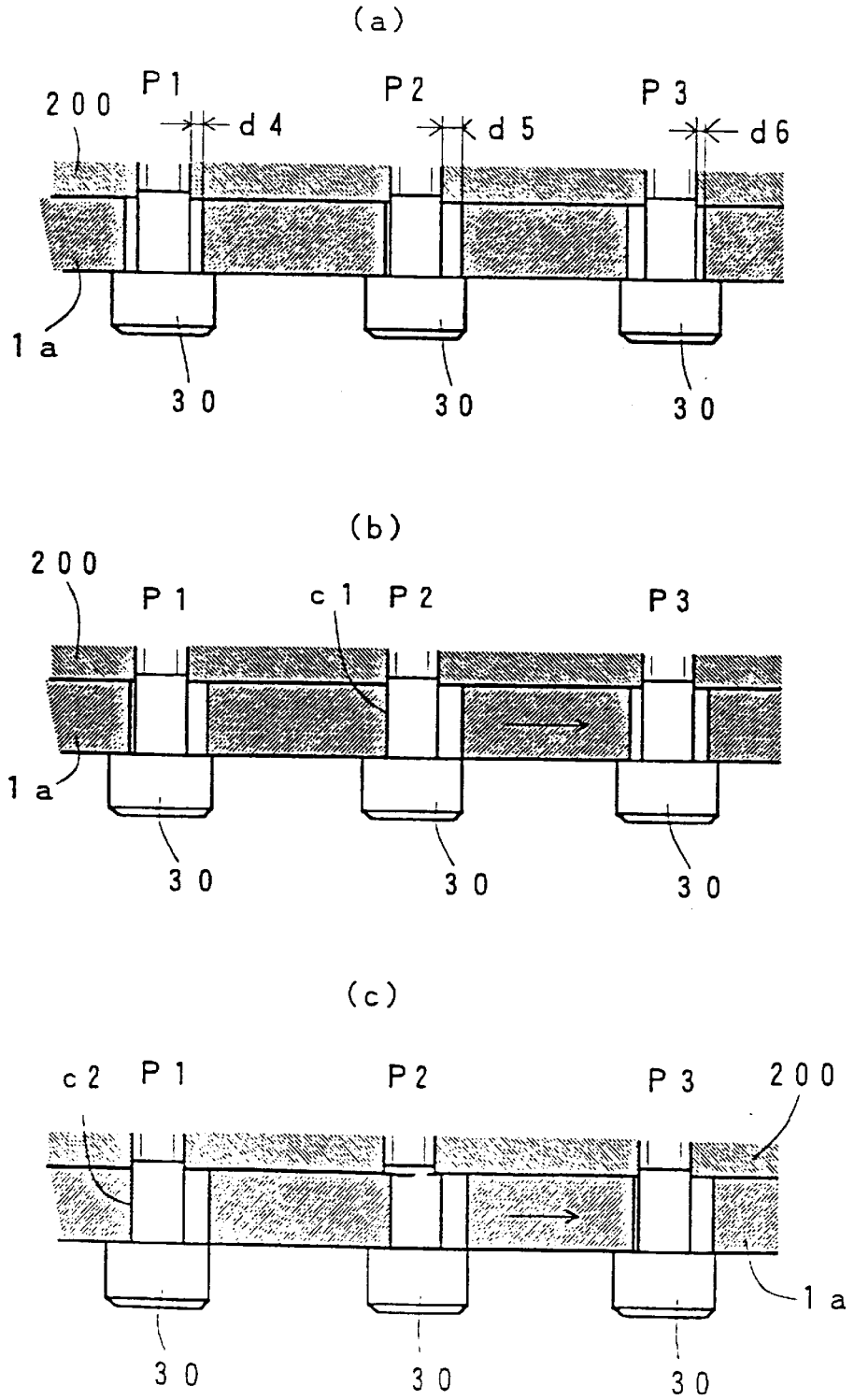
FIGS. 5(*a*), 5(*b*), and 5(*c*) illustrate a process in which the flange portion shown in FIG. 4 is shifted relative to the chamber when a damaging torque is exerted on the flange portion.

FIG. 5(*a*) illustrates a normal assembled state.

FIG. 5(*b*) illustrates a state in which the damaging torque is exerted on the flange portion 1*a* of the vacuum pump in the direction shown by the arrow indicated in the figure, the flange portion 1*a* slips rightward in the figure, and then the shank of the pump-chamber fastening bolt 30 at the second bolt position P2 abuts against the inner wall c1 of the corresponding flange portion fastening bolt-hole 3. During this process, the damaging torque is absorbed by the slippage of the flange portion 1*a* relative to the vacuum chamber 200.

FIG. 5(*c*) illustrates another state in which the remaining damaging torque causes the bolt 30 at the bolt position P2 to be deformed and then the shank of the pump-chamber fastening bolt 30 at the first bolt position P1 to abut against the inner wall c2 of the corresponding vacuum chamber fastening bolt-hole 3. During this process, the damaging torque is further absorbed by the slippage of the flange portion 1*a* relative to the vacuum chamber 200 and also by the deformation of the bolt 30 at P1 and P2 of the first and second bolt position P2, respectively.

When the braking torque is not completely absorbed, the bolt 30 at the first bolt position P1 also starts its deformation, and the shank of the pump-chamber fastening bolt 30 at the bolt position P3 abuts against the inner wall of the corresponding flange portion fastening bolt-hole 3. During this process, the remaining damaging torque is still further absorbed by the slippage of the flange portion 1*a* relative to the vacuum chamber 200, and also by the deformations of the bolts 30 at the first and second bolt positions P1 and P2.

As described above, in the joint structure shown in FIGS. 4, and 5(*a*) to 5(*c*), the gaps between the shanks of the bolts and the inner walls of the bolt-holes are intentionally arranged to distribute to any range so that the damaging torque is slowly absorbed at respective fastening portions of the bolts and the bolt holes in a time sequential manner when the pump case 1 slips relative to the vacuum chamber 200 and the base member 4. As a result, the damaging torque has a reduced peak value and accordingly a large shock load may be avoided.

The method for intentionally arranging the gaps to distribute to any range is not limited to those illustrated in FIGS. 4, and 5(*a*) to 5(*c*). For example, the gaps can be intentionally arranged to distribute by forming the bolt-holes having a plurality of diameters or by forming the bolt-holes having a plurality of shapes.

The above described arrangement may be applied to not only a vacuum chamber-vacuum pump fastening portion but also pump case-base member fastening portion or may be applied to the pump case-base member fastening portion only.

The present invention can be also achieved by a combination of the intentional distribution in the gaps between the shanks of the bolt and the inner walls of the bolt-holes and the foregoing buffer members inserted in the gaps between the bolt-holes and the shanks or by another combination of the foregoing intentional distribution in the gaps and the reduced diameter shank bolts. These combinations can be applied to both or either one of the vacuum pump-vacuum chamber fastening portion and the pump case-base member fastening portion.

Figure 7:
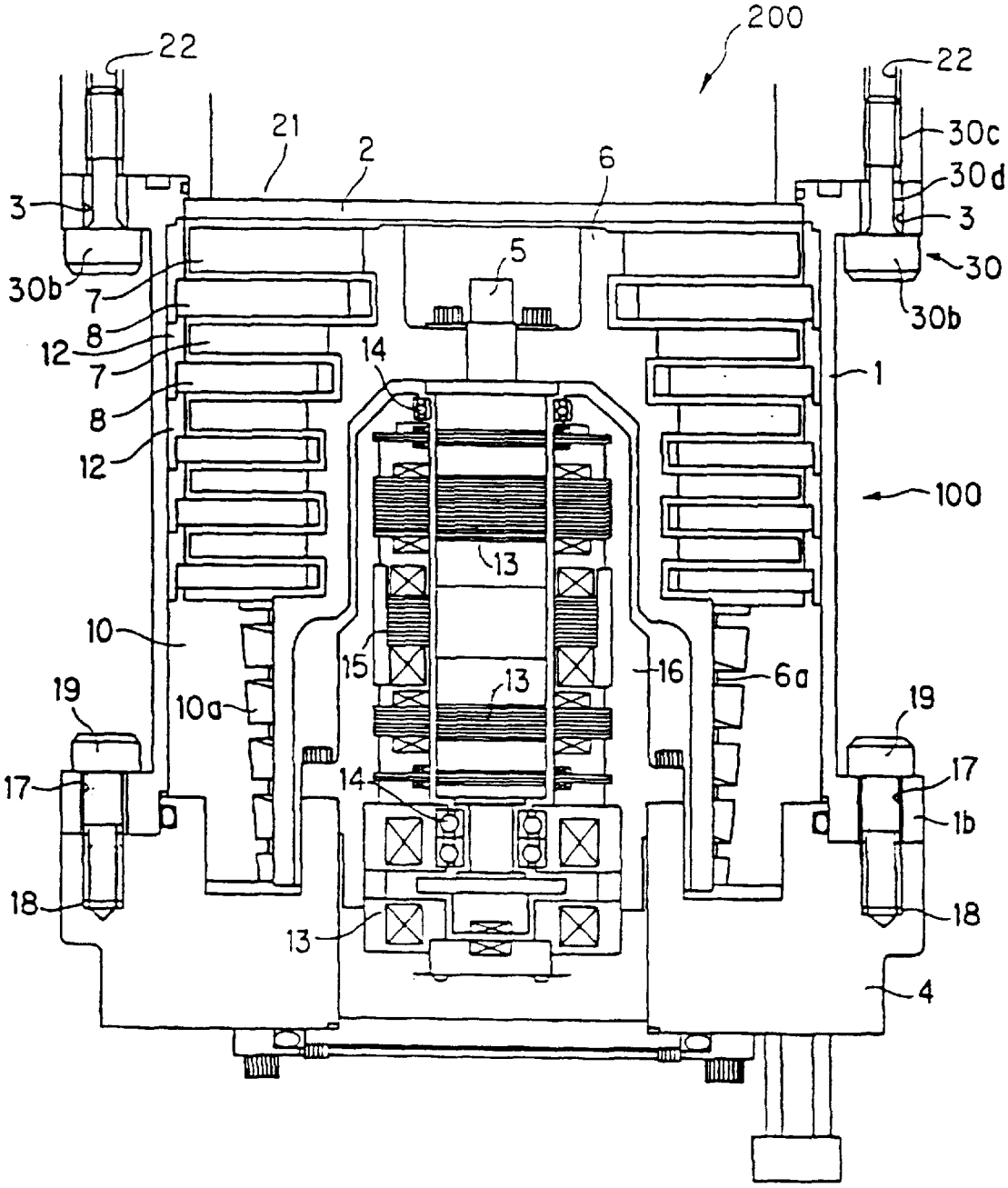
FIG. 7 is a vertical sectional view of another embodiment of a vacuum pump according to the present invention.

FIG. 7 is another embodiment of a vacuum pump in which volt-hole having a larger diameter than shank of fastening volt by 20% or more is provided at the vacuum pump-vacuum chamber fastening portion and a reduced diameter shank bolt is used as fastening bolt, while a combination of standard volt-hole and volt is used for the pump case-base member fastening portion. The other configuration of the vacuum pump is the same as that shown in FIG. 1.

By applying one of joint structures, which will be described below, only to the vacuum pump-vacuum chamber fastening portion, the damaging torque is absorbed by the deformation or partial breaking of the fastening portion, thereby preventing the damaging torque from being transferred to the vacuum chamber 200 and the vacuum pump from being detached from the vacuum chamber 200. That is, the joint structures include (1) a structure in which each bolt-hole has a larger diameter than the shank diameter of a bolt by 20% or more, (2) a structure in which positions of the bolt-holes are shifted relative to the bolts, (3) a structure in which the foregoing structure (1) is combined with a buffer member, (4) a structure in the foregoing structure (2) is combined with a buffer member, (5) a structure in which the reduced diameter shank bolt is used in the foregoing structure (1), (6) a structure in which a reduced diameter shank bolt is used in the foregoing structure (2).

Figure 8:
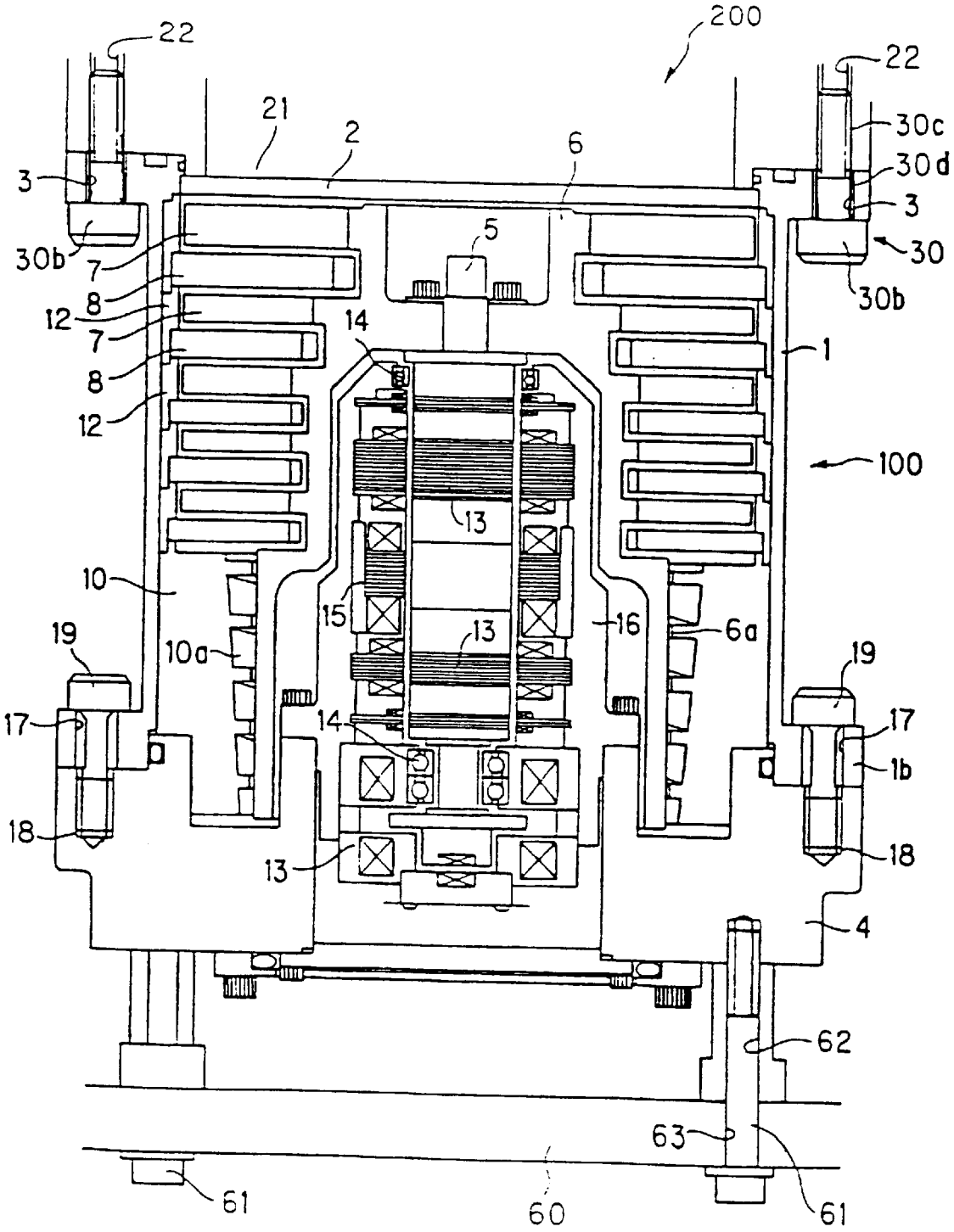
FIG. 8 is a vertical sectional view of further embodiment of a vacuum pump according to the present invention.
Figure 9:
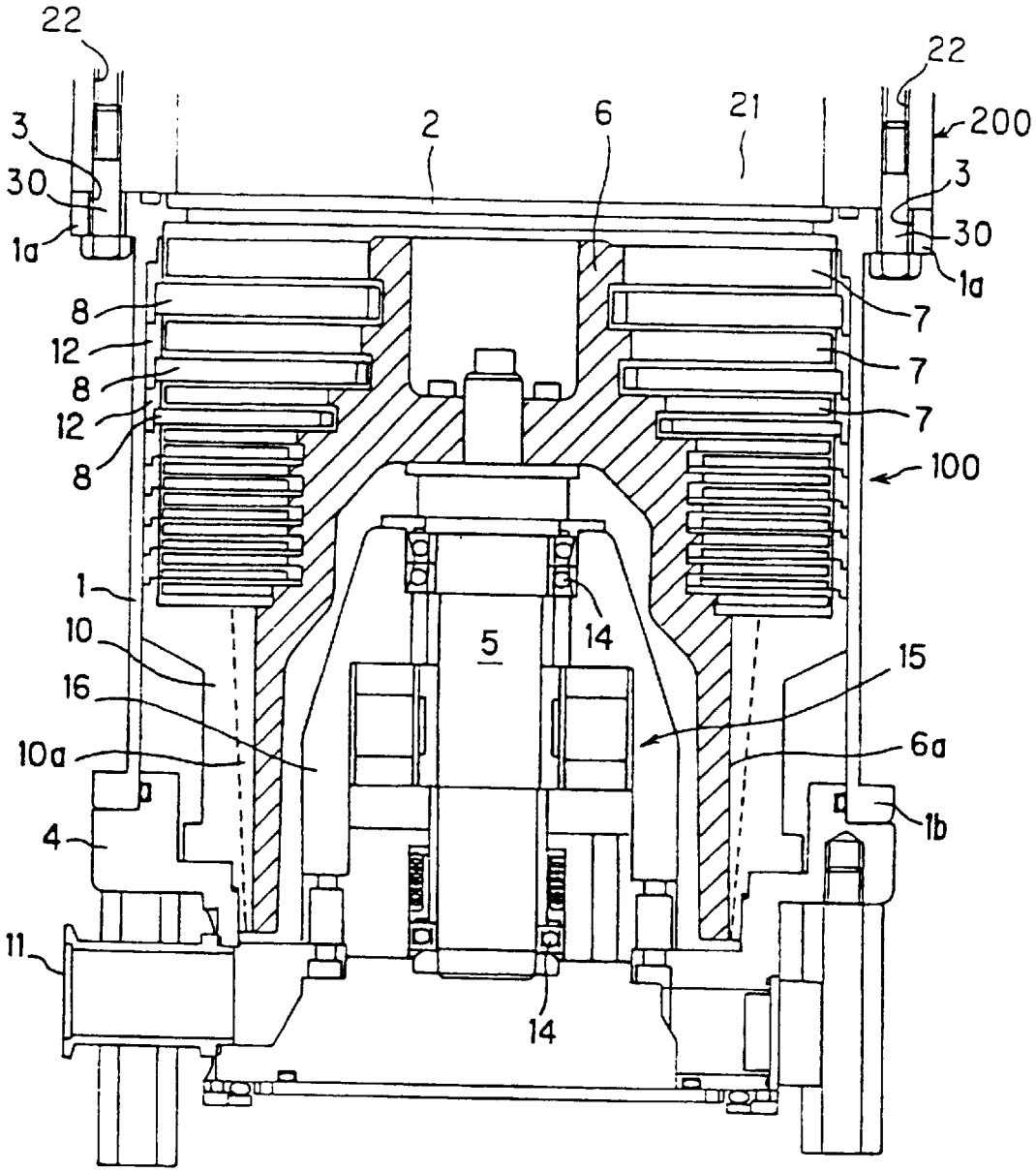
FIG. 9 is a vertical sectional view of a conventional vacuum pump.

FIG. 8 is further embodiment of a vacuum pump in which volt-hole having a larger diameter than shank of fastening volt by 20% or more is provided at the pump case-base member fastening portion and a reduced diameter shank bolt is used as fastening bolt, while a combination of standard volt-hole and volt is used for the pump case-base member fastening portion. The other configuration of the vacuum pump is the same as that shown in FIG. 2.

By applying one of the foregoing joint structures including (1) to (6) only to the pump case-base member fastening portion, the pump case 1 is broken earlier and the base member 4 tends to remain unbroken. Accordingly, the damaging torque is absorbed by the deformations or partial breaking of the fastening portion, thereby preventing the damaging torque from being transferred to the vacuum chamber 200 and the pump 130 from being detached from the vacuum chamber 200.

As described above, each gap between the flange portion fastening bolt-hole and the corresponding pump-chamber fastening bolt or each gap between the lower-flange portion fastening bolt-hole and the corresponding pump case-base member fastening bolt is arranged so as to have a larger diameter than the shank diameter by 20% or more, or the gaps between the bolts and the rear sides of the corresponding bolt-holes with respect to the turning direction of the pump case moved by the damaging torque are arranged so as to distribute to the range including the range of 10% of the shank diameter of the bolt. With this configuration, when a brittle fracture occurs in the rotor rotating at high-speed and thus a damaging torque causing the entire vacuum pump to turn is produced, the pump case of the vacuum pump which is directly subjected to the damaging torque slips relative to the vacuum chamber and the base member by the gaps between the bolts and the corresponding bolt-holes, accordingly causing the damaging torque to be absorbed and reduced, and thereby preventing the damaging torque from being transferred to the chamber and so forth.

When the buffer member is inserted into the foregoing gap, the damaging torque is more remarkably reduced by elastic deformation of the buffer member.

When the reduced diameter shank bolt is used as the foregoing fastening bolt, the damaging torque is more remarkably reduced by deformation of the reduced diameter shank bolt deformed by the damaging torque.

What is claimed is:

1. A vacuum pump comprising:

a rotor;

a pump case surrounding the rotor;

a flange portion formed around the top periphery of the pump case;

a plurality of pump fastening holes provided at a periphery of an exhaust port of a vacuum chamber facing the upper surface of the flange portion;

a plurality of vacuum chamber fastening bolt-holes (3) provided in the flange portion so as to correspond to the pump fastening holes, said vacuum chamber fastening bolt-holes being passed through with a pump-chamber fastening bolt;

a base fastening portion formed around the bottom periphery of the pump case;

a base member covering the lower side of rotor and facing the lower surface of the base fastening portion;

a plurality of pump case-base member fastening holes provided so as to correspond to the base fastening portion and the base, respectively; and a plurality of pump case-base member fastening bolts for fastening the pump case and the base by inserting and screwing into the pump case-base member fastening holes;

wherein the dimensional relationships between the diameter of each bolt-hole and that of the shank of the corresponding bolt satisfy both or either one of the following conditions (a) and (b):

(a) a vacuum chamber fastening bolt-hole has a larger diameter than the shank diameter of the corresponding pump-chamber fastening bolt by 20% or more; and (b) a bolt-hole, which is either one of the pump case-base member fastening bolt-holes provided in the base fastening portion and the base, has a larger diameter than the shank diameter of the corresponding pump case-base member fastening bolt by 20% or more.

2. The vacuum pump according to claim 1, wherein a gap between each fastening bolt and the corresponding bolt-hole satisfies both or either one of the following conditions (a) and (b):

(a) a buffer member is inserted into the gap between each pump-chamber fastening bolt and the corresponding vacuum pump fastening bolt-hole; and (b) a buffer member is inserted into the gap between each pump case-base member fastening bolt and the corresponding fastening bolt-hole.

3. The vacuum pump according to claim 1, wherein the fastening bolts satisfy both or either one of the following conditions (a) and (b):

(a) the pump-chamber fastening bolt is an reduced diameter shank bolt; and (b) the pump case-base member fastening bolt is an reduced diameter shank bolt.

4. A vacuum pump comprising:

a rotor;

a pump case surrounding the rotor;

a flange portion formed around the top periphery of the pump case;

a plurality of pump fastening holes provided at a periphery of an exhaust port of a vacuum chamber facing the upper surface of the flange portion;

a plurality of vacuum chamber fastening bolt-holes provided in the flange portion so as to correspond to the pump fastening holes, said vacuum chamber fastening bolt-holes being passed through with a pump-chamber fastening bolt;

a base fastening portion formed around the bottom periphery of the pump case; and a plurality of pump case-base member fastening bolts for fastening the pump case and the base by inserting and screwing into the pump case-base member fastening holes;

wherein the positional relationships between the fastening bolt-holes and the corresponding fastening bolt satisfy both or either one of the following conditions (a) and (b):

(a) when the pump case turns moved by a damaging torque, the gaps between the pump-chamber fastening bolts and the corresponding vacuum chamber fastening bolt-holes with respect to the turning direction of the pump case moved by the damaging torque are distributed to the range including the range of 10% of the shank diameter of the bolt; and (b) when the pump case turns moved by a damaging torque, the gaps between the pump case-base member fastening bolts and the corresponding bolt-holes with respect to the turning direction of the pump case moved by the damaging torque are distributed to the range including the range of 10% of the shank diameter of the bolt.

5. The vacuum pump according to claim 4, wherein a gap between each fastening bolt and the corresponding bolt-hole satisfies both or either one of the following conditions (a) and (b):

(a) a buffer member is inserted into the gap between each pump-chamber fastening bolt and the corresponding vacuum pump fastening bolt-hole; and (b) a buffer member is inserted into the gap between each pump case-base member fastening bolt and the corresponding fastening bolt-hole.

6. The vacuum pump according to claim 4, wherein the fastening bolts satisfy both or either one of the following conditions (a) and (b):

(a) the pump-chamber fastening bolt is an reduced diameter shank bolt; and (b) the pump case-base member fastening bolt is an reduced diameter shank bolt.

7. joint structure of a vacuum pump, comprising:

a plurality of pump fastening holes provided at periphery of an exhaust port of a vacuum chamber;

a flange portion formed around the top periphery of the pump case, which surrounds the rotor of the vacuum pump;

a plurality of vacuum chamber fastening bolt-holes provided in the flange portion so as to correspond to the pump fastening holes; and a plurality of pump-chamber fastening bolts for fastening the periphery of the exhaust port of a vacuum chamber and the flange portion by inserting and screwing into the pump fastening holes and the pump fastening holes, wherein either diameter of the pump fastening holes and the vacuum chamber fastening holes has a larger diameter than the shank diameter of the corresponding pump-chamber fastening bolt by 20% or more.

8. The joint structure of a vacuum pump according to claim 7, wherein a buffer member is inserted into the gap between each pump-chamber fastening bolt and the corresponding bolt-hole which is either one of the vacuum chamber fastening hole and the pump fastening hole.

9. The joint structure of a vacuum pump according to claim 7, wherein the pump-chamber fastening bolt is a reduced diameter shank bolt.

10. a joint structure of a vacuum pump, comprising:

a plurality of pump fastening holes provided at periphery of an exhaust port of a vacuum chamber;

a flange portion formed around the top periphery of the pump case, which surrounds the rotor of the vacuum pump;

a plurality of vacuum chamber fastening bolt-holes provided in the flange portion so as to correspond to the pump fastening holes; and a plurality of pump-chamber fastening bolts for fastening the periphery of the exhaust port of a vacuum chamber and the flange portion by inserting and screwing into the pump fastening holes and the pump fastening holes, wherein when the pump case turns moved by a damaging torque, the gaps between the pump-chamber fastening bolts and the corresponding vacuum chamber fastening bolt-holes with respect to the turning direction of the pump case moved by the damaging torque are distributed to the ranges including the range of 10% of the shank diameter of the bolt.

11. The joint structure of a vacuum pump according to claim 10, wherein a buffer member is inserted into the gap between each pump-chamber fastening bolt and the corresponding bolt-hole which is either one of the vacuum chamber fastening hole and the pump fastening hole.

12. The joint structure of a vacuum pump according to claim 10, wherein the pump-chamber fastening bolt is a reduced diameter shank bolt.

* * * * *